US007856692B2

(12) United States Patent
Rosso et al.

(10) Patent No.: US 7,856,692 B2
(45) Date of Patent: Dec. 28, 2010

(54) OFFSET TAPING KNIFE

(75) Inventors: Aaron Charles Rosso, Chicago, IL (US); Matthew Earle Myers, Naperville, IL (US); Scott Fong, Causeway Bay (HK)

(73) Assignee: United States Gypsum Company, Chicago, IL (US)

( * ) Notice: Subject to any disclaimer, the term of this patent is extended or adjusted under 35 U.S.C. 154(b) by 970 days.

(21) Appl. No.: 11/713,281

(22) Filed: Mar. 2, 2007

(65) Prior Publication Data

US 2008/0209658 A1 Sep. 4, 2008

(51) Int. Cl.
*B05C 17/10* (2006.01)

(52) U.S. Cl. ..... 15/235.4; 15/145; 15/245.1

(58) Field of Classification Search ..... 15/145, 15/235.4, 236.01, 245.1; 30/169
See application file for complete search history.

(56) References Cited

U.S. PATENT DOCUMENTS 2,231,267 A * 2/1941 Giddings ..... 30/2
3,069,713 A * 12/1962 Obraske ..... 15/245.1
3,815,648 A 6/1974 Dreier
4,779,301 A * 10/1988 Millette ..... 15/105
RE34,979 E 6/1995 Gringer
5,720,063 A * 2/1998 Chacon ..... 7/165
6,742,215 B2 6/2004 Panfili et al.
6,954,958 B2 10/2005 Stubbs
2001/0037534 A1 11/2001 Bryan
2004/0123470 A1 7/2004 Gray
2005/0072006 A1 4/2005 Lee et al.
2008/0060159 A1 * 3/2008 Martin ..... 15/235.4

* cited by examiner

*Primary Examiner*—Randall Chin
(74) *Attorney, Agent, or Firm*—Greer, Burns & Crain, Ltd.; Philip T. Petti, Esq.; Pradip K. Sahu, Esq.

(57) ABSTRACT

A taping knife, including a blade having a proximal end and a distal end, a bracket having a first portion arranged generally parallel to the blade and attached to the blade proximal end and a second portion arranged generally perpendicular to the first portion, and a handle configured for rotation-free engagement with the bracket second portion.

18 Claims, 4 Drawing Sheets

OFFSET TAPING KNIFE

FIELD OF THE INVENTION

This invention relates to wallboard or plaster finishing tools, and more specifically to a taping knife for use in applying joint compound, the taping knife having an offset handle.

Finishing tools for wallboard or plaster, known in the art as taping knives, are used for applying joint compound to wallboard joints or in smoothing or otherwise working wet plaster, and are well known in the art. Traditional taping knives generally include a handle attached to and coaxially aligned with a blade. One problem typically experienced in such taping knives is that during use, the user's hand can interfere with and disturb the joint compound as it is being applied because the handle is coaxially aligned with the blade, providing little or negligible clearance between the handle and the joint compound. Another common problem with such taping knives is user discomfort. Specifically, to avoid interference with the joint compound, the user's hand must generally be angled and held away from the wallboard, preventing a complete grip on the handle and causing discomfort or cramping, especially after extended periods of continued use.

To overcome these problems, taping knives have been developed where the handle is offset from the blade, providing additional clearance between the handle and the joint compound. In U.S. Pub. No. 2001/0037534 to Bryan, a wallboard tool is disclosed where the handle is attached to a mounting bracket and is arranged transversely offset from the blade. The mounting bracket is composed of several components attached to each other by a plurality of fasteners. Similarly, in U.S. Pub. No. 2005/0072006 to Lee et al., a finishing tool is disclosed where the handle is attached to a mounting bracket and oriented transversely offset from the blade. In Lee, the mounting bracket includes an L-shaped portion attached to the blade and a second portion attaching the L-shaped portion to the handle. The handle is threadably attached to the second portion by a fastener.

In Lee, the handle is detachable from the bracket so that the user can directly grip the bracket during use for perceived operator control and improved ergonomics. However, one problem found in Lee is that due to the threaded attachment the handle can become loosened during use, preventing proper use of the tool and reducing efficiency, because the user must stop work and retighten the handle to the bracket.

Another problem found in both Lee and Bryan is that the mounting bracket is generally made from several components which can become loosened during use and prevent proper functioning of the knife. Further, the configuration of the mounting bracket components has been known to cause user discomfort because the user's hand is typically in contact with or often grips the mounting bracket during use.

Accordingly, there is a need for an improved offset taping knife having a handle that remains more positively secured to the mounting bracket/blade during continued use. There is a further need for an improved offset taping knife having a mounting bracket that will not loosen during use. Also, there is a need for an improved offset taping knife mounting bracket that increases comfort to the user's hand during use of the knife.

BRIEF DESCRIPTION OF THE INVENTION

The above-listed objects are met or exceeded by the present taping knife having a handle offset from the blade that features a handle that is non-rotatably attached to a mounting bracket for preventing rotation of the handle relative to the bracket during use. Also, the mounting bracket of the present offset taping knife is integrally formed to provide comfort to the user's hand during application of the joint compound.

More specifically, an offset taping knife is provided and includes a blade having a proximal end and a distal end, a bracket having a first portion arranged generally parallel to the blade and attached to the blade proximal end, and a second portion arranged generally perpendicular to the first portion, and a handle configured for rotation-free engagement with the bracket second portion.

DETAILED DESCRIPTION OF THE INVENTION

Figure 1:
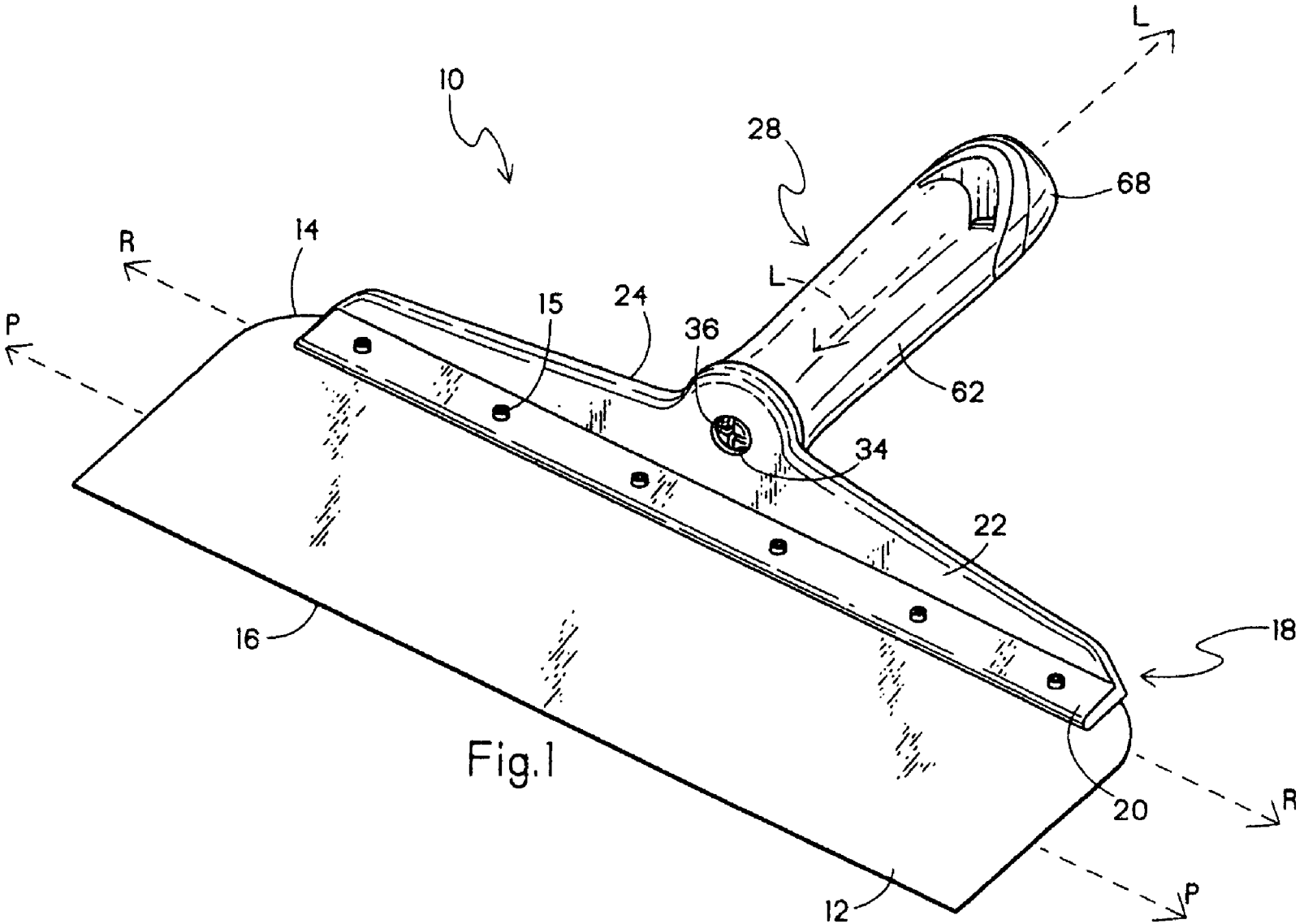
FIG. 1 is a top perspective view of the present offset taping knife.
Figure 2:
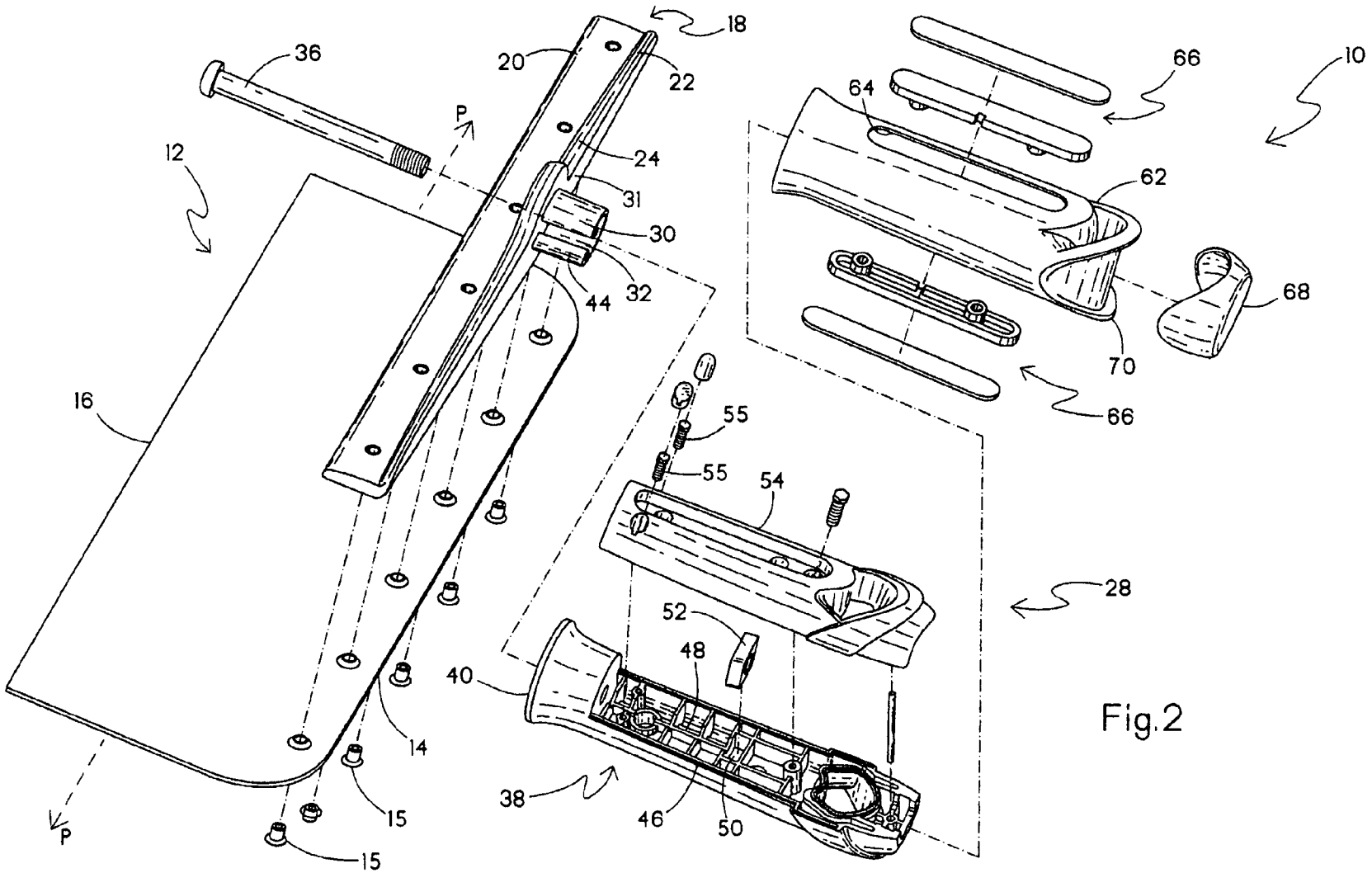
FIG. 2 is an exploded perspective view of the taping knife of FIG. 1.

Referring to FIGS. 1 and 2, a taping knife is disclosed and generally designated 10, and includes a blade 12 having a proximal end 14 and a distal end 16. As known in the art, the blade 12 is preferably manufactured from blue spring steel due to its durability, strength and ease of cleaning, although it is appreciated that other materials may be suitable, including but not limited to stainless steel. The blade 12 is preferably approximately 8.9 cm (3½ inches) in length, from the proximal to the distal ends 14, 16, and preferably has a straight edge. However, it is recognized that other dimensions may be appropriate, depending on the application.

The taping knife 10 further includes an elongate, preferably L-shaped (in side view) bracket 18 having a first portion 20 arranged generally parallel to a plane "P" defined by the blade 12 and attached to the blade proximal end 14, and a second portion 22 arranged generally perpendicular to the first portion. When the blade 12 rests upon a substrate such as a table, the first portion 20 is generally horizontal and the second portion 22 is generally vertical. Although other methods of attachment are contemplated, the first portion 20 is preferably secured to the blade proximal end 14 by a plurality of fasteners 15, such as rivets, as known in the art. To provide adequate support to the blade 12 during use, the first portion 20 extends along a longitudinal axis "R" or width of the blade and preferably extends close to opposing ends of the blade, as seen in FIG. 1. It is preferred that the first portion 20 not exceed the width of the blade 12.

Due to its strength, durability, weight and cost characteristics, the bracket 18 is preferably manufactured from aluminum, although other materials with similar properties are contemplated. Unlike the taping knives in Lee and Bryan, where the bracket is formed of several components attached together by fasteners or the like, the bracket 18 is preferably integrally formed from a single piece of aluminum. In Lee and Bryan, there is a risk that the components of the mounting bracket may become loosened or separated after continued use, requiring repair and reducing work efficiency. By integrally forming the bracket 18, it is contemplated that this risk is greatly reduced. It is also contemplated that the integrally formed bracket 18 enhances user comfort because there are no fasteners or additional components on the bracket that would interfere with the user's hand. It is further contemplated that the integrally formed bracket 18 reduces production cost because only a single piece of aluminum is utilized, and there is no need for fasteners to secure components of the bracket together.

Best seen in FIG. 1, the bracket second portion 22 includes a peripheral edge 24 that is continuous, inclined and radiused. Unlike conventional taping knives, which generally include a mounting bracket composed of several components having straight peripheral edges, it is contemplated that the peripheral radiused edge 24 further enhances user comfort when the user's hand/fingers rest on or extend over the radiused edge.

The present taping knife 10 further includes a handle 28 configured for rotation-free engagement with the bracket second portion 22. By "rotation-free" is meant that upon attachment of the handle 28 and the second portion 22, the handle is not rotatable relative to the second portion. As shown in FIG. 1, a longitudinal axis "L" of the handle 28 is transversely offset from the plane "P" defined by the blade 12. Further, the axis "L" is generally parallel to the plane "P". It is contemplated that by arranging the handle transversely offset from the blade 12, the user's hand will not interfere with the newly applied joint compound because of the clearance between the handle 28 and the joint compound.

Figure 3:
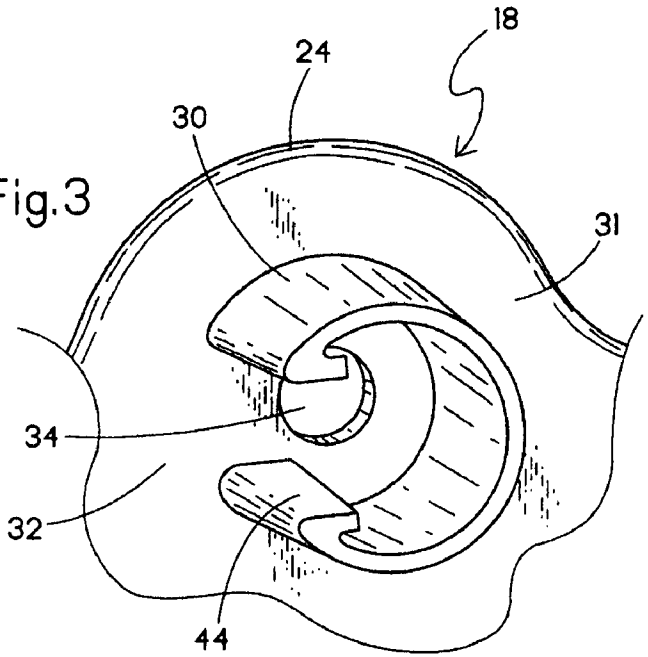
FIG. 3 is a close-up perspective view of a mounting bracket protrusion of the present taping knife.

Referring now to FIGS. 2 and 3, the bracket second portion 22 includes a protrusion 30 extending coaxial to, and configured for engaging the handle 28. The protrusion 30 extends from a rear surface 31 of the second portion 22. To prevent breakage and enhance strength, the protrusion 30 is preferably integrally formed with the bracket second portion 22. Although other shapes are contemplated, the protrusion 30 is preferably generally cylindrical in shape and is most preferably generally "C"-shaped when viewed from the handle and defines a gap 32, best seen in FIG. 3. The protrusion 30 preferably extends between 12-18 mm (0.47-0.71 in) from the second portion 22, and has a diameter of between 16-20 mm (0.63-0.78 in). Most preferably, the protrusion 30 extends approximately 15 mm (0.59 in) from the second portion 22 and has a diameter of 18 mm (0.71 in), although it is appreciated that other dimensions may be suitable, depending on the application. The protrusion 30 partially surrounds a through-hole 34 configured for receiving a fastener 36 (FIG. 5), which will be described in further detail below.

Figure 4:
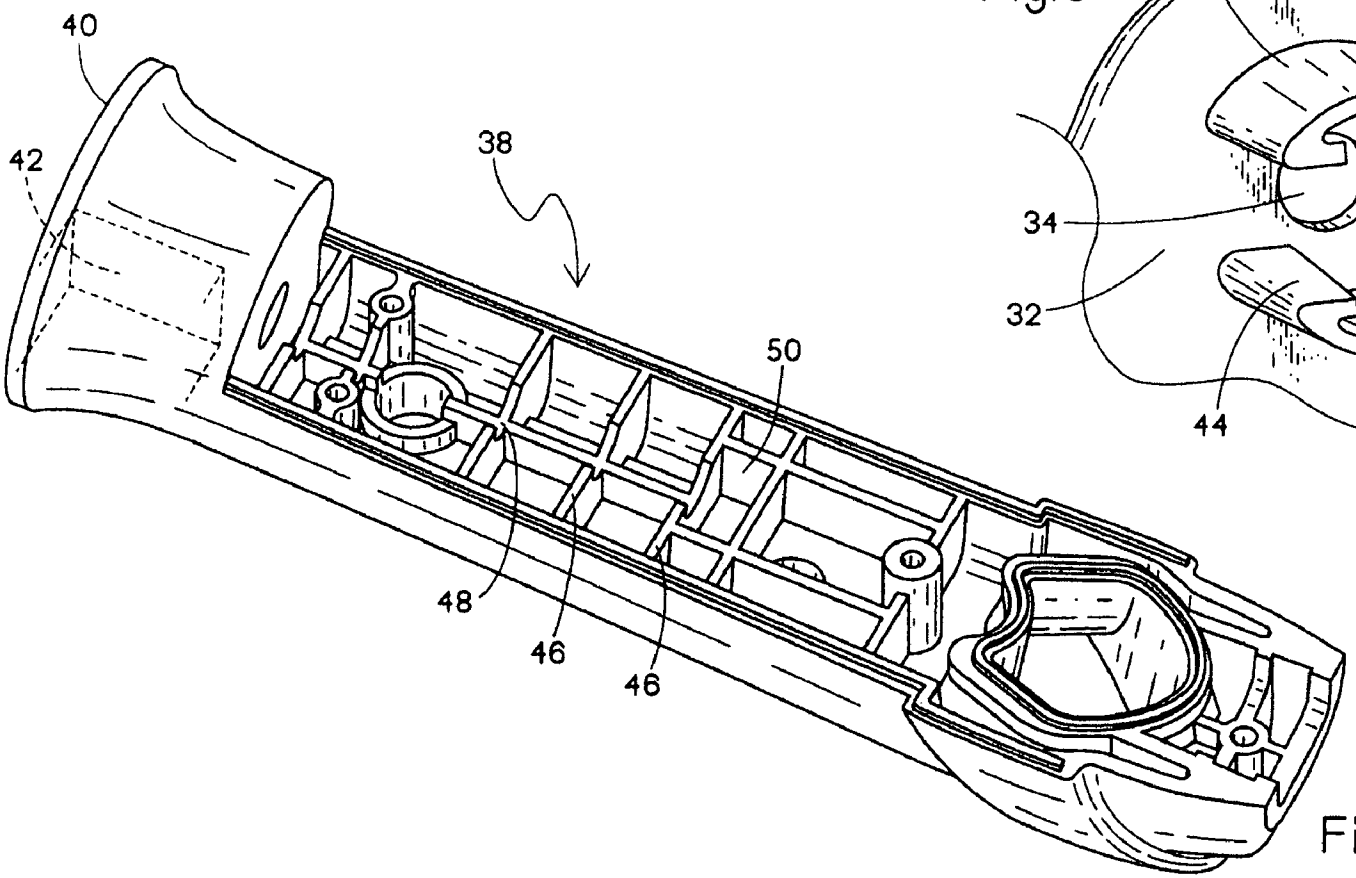
FIG. 4 is a front perspective view of a first half of the handle of the present taping knife.

As seen in FIG. 4, the handle 28 includes a first half 38 defining a preferably cylindrical opening 40 having a radially inwardly projecting lug 42 (shown hidden) constructed and arranged for being received in the gap 32. The opening 40 is preferably constructed and arranged for alignment with the through-hole 34. To further secure the handle 28 to the bracket 18, opposing ends of the gap 32 each include a generally planar foot 44 constructed and arranged for abuttingly engaging opposing sides of the lug 42. Best seen in FIG. 3, each foot 44 preferably extends inwardly towards the through-hole 34, and is arranged generally parallel to the plane "P" of the blade 12, although other orientations may be suitable depending on the orientation of the lug 42.

To secure the handle 28 to the bracket 18, the user orients the handle such that the lug 42 is aligned with the gap 32, and pushes the handle opening 40 onto the protrusion 30 so that the protrusion is telescopically received in the opening. It is contemplated that upon engagement of the protrusion 30 and the opening 40, the handle 28 cannot be rotated relative to the bracket 18. It is further contemplated that unlike current taping knives, where the handle is generally threadably attached to the bracket, the handle 28 and mounting bracket second portion 22 are non-rotatably engaged, preventing loosening of the handle relative to the bracket.

Figures 5, 6:
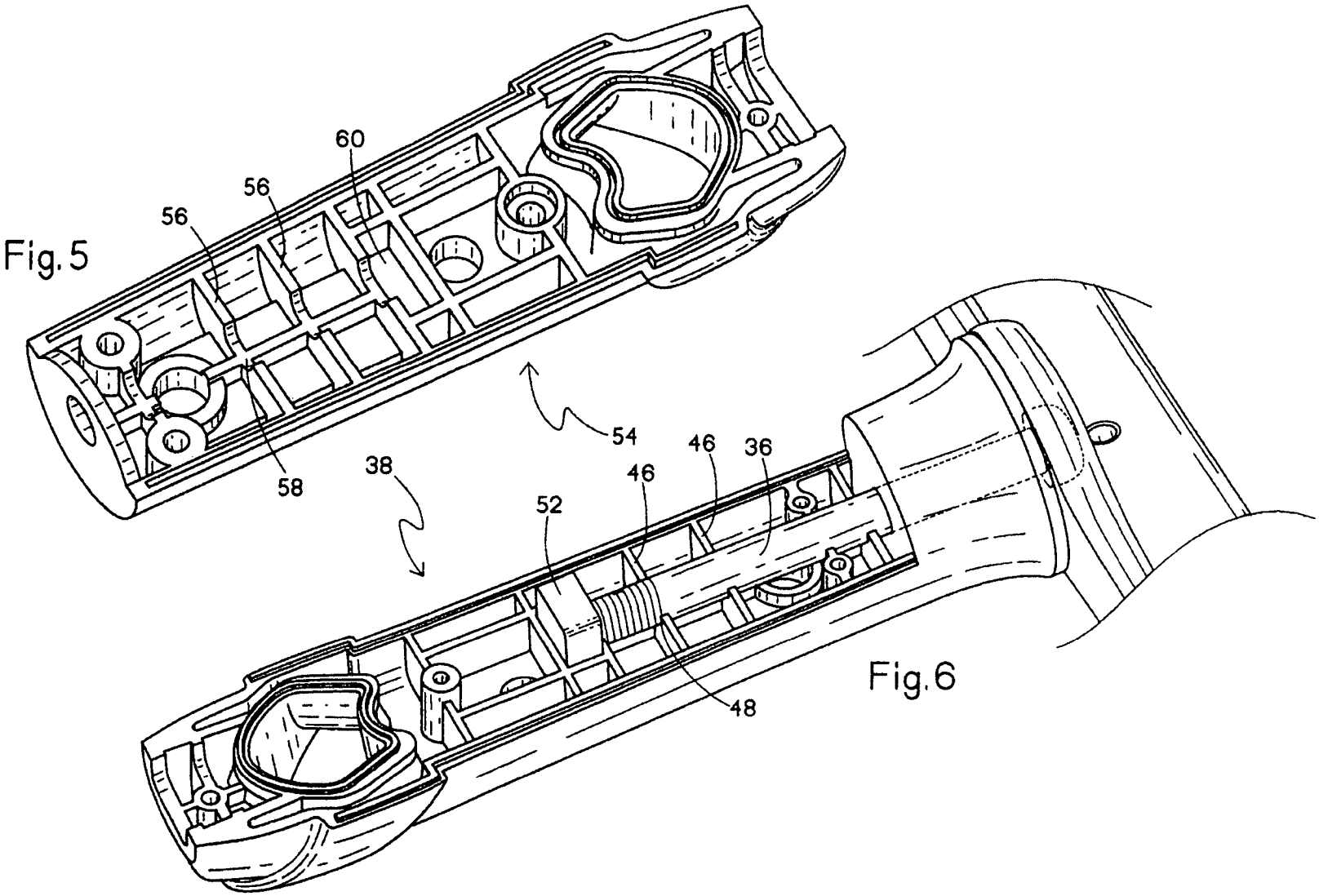
FIG. 5 is a front perspective view of a second half of the handle of the present taping knife.
FIG. 6 is a fragmentary overhead perspective view of the assembled taping knife of FIG. 1 with portions omitted for clarity.

Referring to FIGS. 4 and 6, the handle first half 38 further includes a plurality of ribs 46 defining a generally hemispherical first channel 48 for receiving the fastener 36. It is contemplated that the ribs 46 provide strength and support to the handle 28, as known in the art, although other structural components may be suitable. The first channel 48 extends partially through the first half 38, as seen in FIG. 4. A first recess 50 is provided adjacent the channel 48 for receiving and capturing a nut 52. Preferably, the nut 52 has a square or otherwise non-circular outer peripheral shape, and the recess 50 is complementarily shaped, to prevent rotation of the nut within the recess, although other configurations may be suitable, depending on the application.

Upon mating engagement of the handle 28 and the bracket second portion 22, as described above, the fastener 36 is placed through the through-hole 34 and the opening 40 and rests in the channel 48. The fastener 36 threadably engages the nut 52 for removably securing the handle 28 to the bracket 18 and further preventing rotation of the handle relative to the bracket. It is contemplated that the fastener 36 also acts as a spine for the handle 28, providing enhanced structure and rigidity.

Referring now to FIG. 5, the handle 28 further includes a second half 54 constructed and arranged for engagement to the first half 38 by a plurality of fasteners 55 such as screws (FIG. 2). Similar to the first half 38, the second half 54 includes a plurality of ribs 56 defining a generally hemispherical second channel 58 configured for accommodating and being engaged by the fastener 36 upon attachment to the first half. As stated above with respect to the first half 38, it is contemplated that the ribs 56 provide structure and strength to the handle 28. Further, adjacent the second channel 58, the second half 54 includes a second recess 60 constructed and arranged for receiving an upper portion of the nut 52.

As known in the art, the first half 38 and second half 54 are preferably manufactured from a resilient and durable plastic, although other similar materials may be suitable. It is contemplated that in comparison to a solidly formed first and second half, the ribs 46, 56 reduce the weight of their respective halves, as well as their manufacturing costs, due to the reduced amount of material necessary to manufacture the halves.

Referring now to FIG. 2, an outer covering 62 is constructed and arranged for covering the assembled first half 38 and second half 54, as disclosed in commonly owned, U.S. patent application Ser. No. 11/187,582, now U.S. Pat. No. 7,434,318, entitled TAPING KNIFE WITH ENLARGED HAMMER ELEMENT, which is herein incorporated by reference in its entirety. Although other materials are contemplated, the covering 62 is preferably manufactured from a resilient, soft grip rubber or equivalent material, enhancing user comfort during use. The covering 62 defines a groove 64 configured for receiving an identification insert assembly 66, as known in the art, and as disclosed in commonly-owned, co-pending U.S. patent application Ser. No. 11/328,530, now pending, entitled TAPING KNIFE WITH INTERCHANGEABLE NAMEPLATES, which is herein incorporated by reference in its entirety.

A hammer element 68 is attached to an outer covering distal end 70, as disclosed in commonly owned, co-ending U.S. patent application Ser. No. 11/187,582, now U.S. Pat. No. 7,434,318, entitled TAPING KNIFE WITH ENLARGED HAMMER ELEMENT. It is contemplated that the hammer element 68 is manufactured from zinc, and in addition to functioning as a traditional hammer, enables the user to write on the wallboard joint compound to mark mistakes or areas that need improvement. However, it is recognized that other materials may be appropriate, depending on the application.

Accordingly, the present offset taping knife handle 28 is non-rotatably attached to the second portion 22, and in contrast to conventional taping knives, when the fastener 36 is removed, the user can remove the handle from the second portion by gripping the handle and pulling in a direction parallel to the plane "P" formed by the blade. Further, because of the non-rotatable attachment, the handle 28 will not become loosened during use, unlike conventional taping knives, which generally include handles that are only threadably attached to the mounting bracket.

While a particular embodiment of an offset taping knife has been shown and described, it will be appreciated by those skilled in the art that changes and modifications may be made thereto without departing from the invention in its broader aspects and as set forth in the following claims.

What is claimed is:

1. A taping knife, comprising:

a blade having a proximal end and a distal end;

a bracket having a first portion arranged generally parallel to said blade and attached to said blade proximal end and a second portion arranged generally perpendicular to said first portion;

a handle;

a protrusion extending from said second portion of said bracket; and an opening defined by said handle, a radially inwardly projecting lug in said opening, said lug configured for non-threaded, rotation-free engagement with a gap defined by said protrusion.

2. The taping knife of claim 1 wherein a longitudinal axis of said handle is transversely offset from a plane defined by said blade.

3. The taping knife of claim 1 wherein said handle includes an inner core defining said opening having said lug.

4. The taping knife of claim 3 wherein upon engagement, said protrusion and said opening generally form a cylinder.

5. The taping knife of claim 3 wherein opposing ends of said gap each include a foot constructed and arranged for engaging corresponding sides of said lug.

6. The taping knife of claim 1 wherein said protrusion partially surrounds a through-hole configured for receiving a fastener.

7. The taping knife of claim 6 wherein an inner core of said handle includes said opening, said opening being constructed and arranged for alignment with said through-hole.

8. The taping knife of claim 1 wherein a fastener extends partially through an inner core of said handle and threadably engages a generally square nut for removably securing said handle to said bracket and further preventing rotation of said handle relative to said bracket.

9. The taping knife of claim 1 wherein said bracket is integrally formed.

10. The taping knife of claim 1 wherein said bracket second portion includes a peripheral edge having a continuous, inclined, radiused edge.

11. A taping knife, comprising:

a blade having a proximal end and a distal end;

a bracket attached to said blade proximal end and including a first portion arranged generally parallel to said blade and a second portion arranged generally perpendicular to said first portion, a protrusion extending transversely from said second portion of said bracket, said protrusion being generally cylindrical and generally C-shaped;

a handle including an inner core defining an opening constructed and arranged for engaging said protrusion, said handle being transversely offset from said blade; and a fastener configured for securing said handle to said bracket.

12. The taping knife of claim 11 wherein said opening is constructed and arranged for non-threaded and non-rotatable engagement with said protrusion.

13. The taping knife of claim 11 wherein said generally C-shaped protrusion defines a gap and said opening includes a lug constructed and arranged for being received in said gap to provide a non-rotatable attachment between said handle and said bracket.

14. The taping knife of claim 11 wherein upon engagement, said protrusion and said opening generally form a cylinder.

15. The taping knife of claim 11 wherein said fastener partially extends through said inner core and threadably engages a square nut further securing said handle to said bracket.

16. The taping knife of claim 11 wherein said bracket is integrally formed.

17. A taping knife, comprising:

a blade having a proximal end and a distal end;

an integrally formed bracket including a first portion arranged generally parallel to said blade and attached to said blade proximal end and a second portion arranged generally perpendicular to said first portion and having a peripheral edge opposite said blade, said peripheral edge including a continuous, inclined radiused edge, said second portion having a front surface and a rear surface;

a protrusion extending from said rear surface and defining a gap;

a handle defining an opening including a lug engaged with said gap, a longitudinal axis of said handle being transversely offset from a plane defined by said blade; and a fastener configured for removably securing said handle to said bracket.

18. The taping knife of claim 17 wherein said protrusion is generally C-shaped and defines said gap, and said handle includes an inner core defining said opening having said lug constructed and arranged for non-threadably and non-rotatably engaging said gap.

* * * * *